US006253054B1

(12) United States Patent
Maess et al.

(10) Patent No.: US 6,253,054 B1
(45) **Date of Patent: *Jun. 26, 2001**

(54) MODULAR ELECTROPHOTOGRAPHIC MULTICOLOR PRINTER

(75) Inventors: Volkhard Maess, Erding; Martin Schleusener, Zorneding, both of (DE)

(73) Assignee: Oce Printing Systems GmbH, Poing (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/284,769

(22) PCT Filed: Oct. 16, 1997

(86) PCT No.: PCT/DE97/02389

§ 371 Date: May 24, 1999

§ 102(e) Date: May 24, 1999

(87) PCT Pub. No.: WO98/18056

PCT Pub. Date: Apr. 30, 1998

(30) Foreign Application Priority Data

Oct. 17, 1996 (DE) ..... 196 42 890

(51) Int. Cl.[7] ..... G03G 15/01
(52) U.S. Cl. ..... 399/302; 399/306; 399/309
(58) Field of Search ..... 399/110, 111, 399/112, 113, 298, 299, 302, 306, 308, 309, 301, 304, 303, 401, 384

(56) References Cited

U.S. PATENT DOCUMENTS

| | | | | |
|---|---|---|---|---|
| 3,580,670 | * | 5/1971 | Bhagat | 399/306 |
| 4,188,110 | | 2/1980 | Stange . | |
| 4,958,187 | * | 9/1990 | Tsuchiya et al. | 399/306 |
| 5,014,094 | | 5/1991 | Amitani et al. . | |
| 5,121,171 | * | 6/1992 | Knapp | 399/299 |
| 5,138,389 | * | 8/1992 | Randall | 399/302 |
| 5,258,809 | | 11/1993 | Wiedemer . | |
| 5,282,012 | * | 1/1994 | Terada et al. | 399/112 |
| 5,303,018 | * | 4/1994 | Terada et al. | 399/299 |
| 5,526,107 | * | 6/1996 | Bronstein | 399/299 |
| 5,550,624 | * | 8/1996 | Wachtler | 399/306 |
| 5,552,857 | * | 9/1996 | Ishikawa | 399/113 |
| 5,678,150 | * | 10/1997 | Takahashi et al. | 399/299 |
| 5,740,510 | * | 4/1998 | Van den Bogaert et al. | 399/298 |
| 5,752,137 | * | 5/1998 | Haneda | 399/112 X |
| 5,765,081 | * | 6/1998 | Bogaert et al. | 399/299 |
| 5,797,077 | | 8/1998 | Samizo et al. . | |
| 5,805,967 | * | 9/1998 | DeBock et al. | 399/299 |
| 5,848,323 | * | 12/1998 | Umeda et al. | 399/306 X |
| 5,937,246 | * | 8/1999 | Kaneyama | 399/299 X |

FOREIGN PATENT DOCUMENTS

| | | |
|---|---|---|
| 41 10 348 A1 | 10/1991 | (DE) . |
| 0 659 569 A1 | 6/1995 | (EP) . |

OTHER PUBLICATIONS

Japanese Abstract, Publication No. 08160839, Publication Date Jun. 21, 1996.

Xerox Disclosure Journal, vol. 16, No. 6, Nov./Dec. 1991, pp. 389–390.

* cited by examiner

*Primary Examiner*—Sandra Brase
(74) *Attorney, Agent, or Firm*—Schiff Hardin & Waite

(57) ABSTRACT

An electrophotographic printer includes a print unit with a photoconductor that receives a toner image and another printing unit to produce another toner image. The printer unit is removably fastenable in a receptacle in the printer, and other identically constructed printer units are also fastenable in receptacles in the printer.

2 Claims, 6 Drawing Sheets

MODULAR ELECTROPHOTOGRAPHIC MULTICOLOR PRINTER

Figure 1:
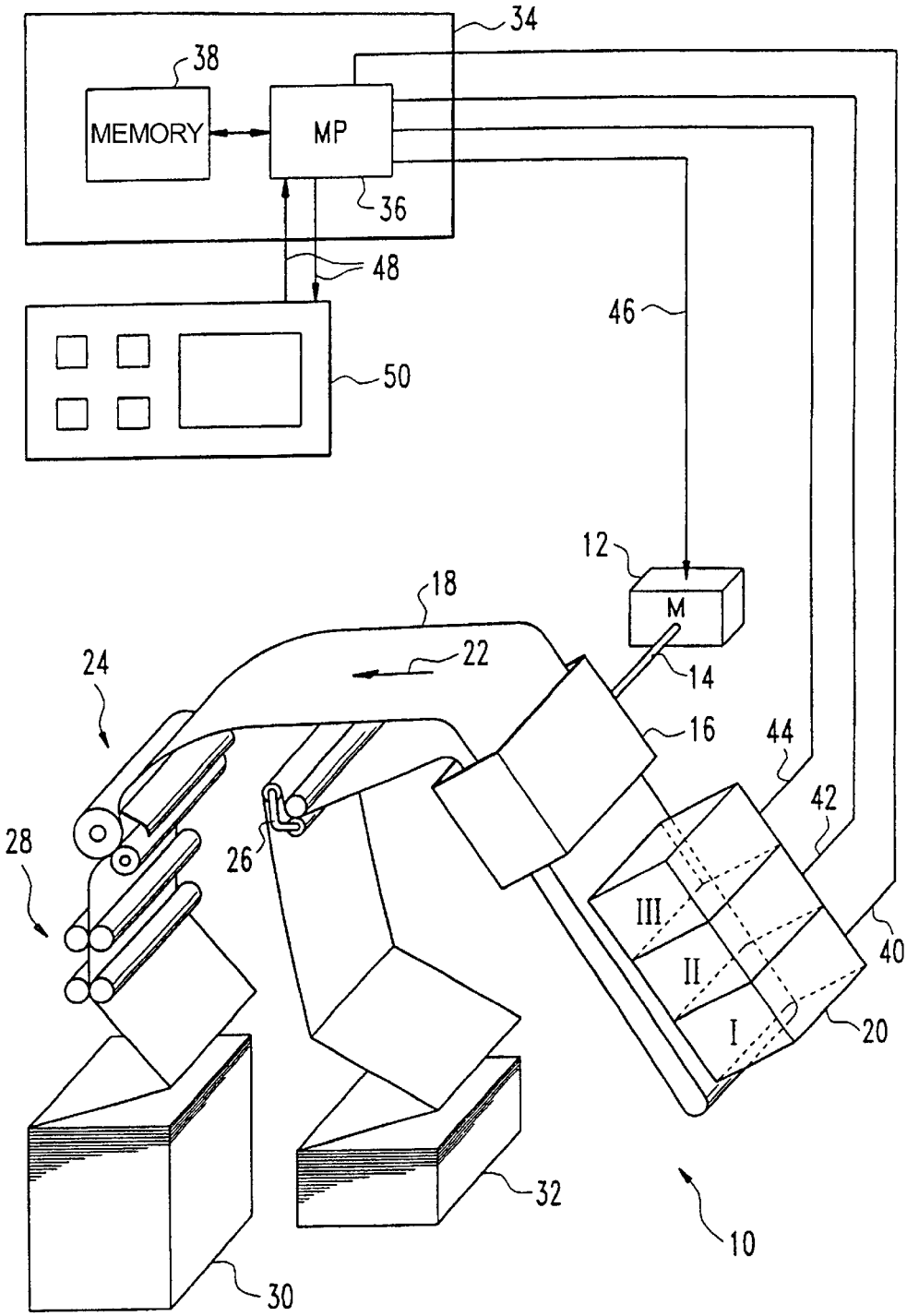

The invention relates to an electrophotographic printer for printing a final image carrier, having a transport means for transporting the final image carrier, having a first print unit for producing a first toner image by means of a first arrangement of colored particles on a first photoconductor, having at least one additional print unit for producing an additional toner image by means of a further arrangement of colored particles on a further photoconductor, and having a transfer means for the direct or indirect transfer of the first toner image from the first photoconductor and of the additional toner image from the additional photoconductor onto a surface segment on the front of the final image carrier.

In the following, a color separation is understood to be a toner image applied by a single developer station. A multicolor toner image accordingly results by means of the superposition of several color separations.

A printer of this type is known for example from the European Laid Open Print EP 0 659 569 A1. In the printer specified there, the first monochromatic toner image (color separation) is fixed before the second toner image, likewise monochromatic, is applied onto the already-fixed first toner image. A well-registered multicolor printing is not possible with the known printer, because it cannot be ensured that the two toner images are printed exactly on the same surface segment of the carrier material. By this means, the image elements of the first toner image and of the second toner image also cannot be oriented precisely to one another. The consequence is that undesired superpositions or empty spaces can occur between image elements of different toner images (registration errors). In the end, a high-quality color printing is not possible.

Given a graduated flat color printing, color falsifications and color fringe effects arise. In addition, in the printing of lines and characters, fuzzy and/or color-falsified image details arise in the area of the lines and characters.

In addition, the printer according to the cited laid open print is inflexible with respect to an adaptation to various print jobs. If for example printing is to take place with only one color, the second printer according to the cited laid open print is superfluous. In addition, with the printer according to EP 0 659 569 A1 selection can take place only from a color palette of four predetermined colors during printing.

In the Laid Open Print DE 41 10 348 A1, a multicolor printer is explained that contains four print units, each having a photoconductor. The toner containers of the print units are connected removably with the printer. In contrast, a removal of the print units themselves is not provided given use of the printer for its intended purpose.

The object of the invention is to indicate a printer which, with a relatively simple construction, enables a multicolor printing of high quality, and which can be adapted rapidly to various print jobs with respect to the number of colors, the combination of simultaneously printable colors, the toner colors used during printing (color palette), and with respect to registration between particular color separations.

This object is achieved by means of a printer having the features of patent claim 1. The printer according to the invention has a module for housing the first print unit in a first receptacle and for housing the additional print unit in an additional receptacle. Since the receptacles are arranged in a module, the spatial distance between the receptacles is small. The receptacles are preferably arranged immediately alongside one another.

In the invention, the first receptacle and the additional receptacle have essentially the same construction. The identical construction of the receptacles ensures that printer units can be exchanged among one another, and that a useful number of print units are placed into the receptacles corresponding to the required print quality. An adaptation of further-developed or, respectively, newly developed print units is possible if in the design of these print units care is taken that they can be placed into the receptacles.

In the invention, at least one of the print units is placed removably into one of the receptacles, i.e., this print unit can easily be placed into the respective receptacle or, respectively, removed from this receptacle. Any measure known to those skilled in the art, such as for example snapping or locking of the respective print unit into the receptacle, may be used here. By means of this measure, it is achieved that the printer according to the invention can be adapted rapidly, i.e., with few manual operations, to various print jobs, in that the removable print unit is removed or put into place, or, respectively, is exchanged for another print unit. Moreover, a changing of developer stations in the print unit, a refilling of toner and the execution of maintenance tasks is made easier, in that a print unit for the respective activity is removed from the module and is put into place again after termination of the activity.

The printer according to the invention can print the final image carrier, for example sheet-type material, preferably paper, directly or indirectly. In the case of indirect printing, an intermediate carrier is used onto which the toner images are transferred before they are finally transferred onto the final image carrier. If, in an embodiment of the invention, an intermediate carrier is used as carrier material, then among other things the superposition of the toner images of various print units can take place in a more precise fashion. The precision of registration is increased in this way, because the photoconductor and the intermediate carrier can be better synchronized than the photoconductor and the final image carrier. Moreover, the intermediate carrier is made of a material that is selected with respect to the interaction between the photoconductor and the intermediate carrier with respect to wear and chemical influence. By this means the photoconductor is worn away less and is worn more uniformly than would be the case given interaction with a final image carrier made for example of paper. In addition, an embodiment of the invention relates to a printer that is suitable for two-sided printing.

An embodiment of the invention relates in addition to an electrophotographic printer for multicolor printing having the features of patent claim 7. This printer operates according to a method designated repeat printing in the following, in which the final image carrier or, respectively, the intermediate carrier is conveyed several times past a print unit that successively applies at least two toner images onto the same surface segment of the carrier material. If the toner image applied in a first printing step has colored particles of at least three colors, then it is ensured that at least image elements with these colors are oriented precisely to one another. If a further toner image, produced in a further printing step, is superposed on the first toner image, then there occur only registration errors between toner images of different print units. The result is that the print quality is increased. By means of the possibility of repeat printing, additional print units can be done without while maintaining the same print quality, whereby, however, a longer printing time, and thus a reduced number of pages printed per time unit, must be accepted. However, in the embodiment of the printer according to the invention an additional print unit can for example be placed into one of the print receptacles for example at a later time, so that the repeat printing can be replaced by multicolor printing in one pass.

A further embodiment of the invention relates to a printer having the features of patent claim 8. This embodiment of the invention is based on the finding that during the application of a toner image the image elements do not deviate from their predetermined positions (well-registered printing). For this reason, in this embodiment of the invention colored particles of at least two colors are applied during the application of one of the toner images. An additive color mixing is thus already possible within a toner image. If colored particles of three colors are applied within a toner image in the invention, then given for example the use of the colors red, blue and green, a multiplicity of other colors can be produced by means of additive color mixing. In this case, among other things black toner can be applied n the second print unit. Given toner images produced by various print units, a registration error is unavoidable.

In additional embodiments of the invention, a print unit is used having the features of patent claim 9 or, respectively, 10. In these embodiments, the photoconductor is exposed according to the image only a single time by means of a single exposure means in the print unit. By this means, it is ensured that the image elements of the color separations of the same print unit have no positional deviation to one another (well-registered printing), in contrast to an exposure two or more times according to the image. Given several exposure steps according to the image, positional deviations (registration errors) between the toner images are always present, for example on the basis of synchronization errors, which cannot be completely avoided, between the photoconductor and the final image carrier or, respectively, between the photoconductor and the intermediate image carrier.

The print unit used in the embodiment can be expanded for the printing of more than two or, respectively, more than three colors in one toner image, by using an additional total exposure unit for lowering the magnitude of the potential at surface elements of the photoconductor that are not yet covered with colored particles, and by subsequently applying colored particles of an additional color. This process can be repeated for each additional color to be applied. By means of this measure, it is already possible in the first toner image to arrange colored particles of at least three or, respectively, at least four different colors next to one another on the toner image. A multiplicity of subtractive coloration effects can be realized in addition to the additive color effects within a single print unit with the aid of the second or additional print units. By expansion of the print units and by addition of additional print units, the color print quality can be adapted to the print job up to full-color printing, for example line and character printing, commercial graphics or high-quality full-color printing.

In an embodiment of the invention, the photoconductor contains only one electrode layer conducting a predetermined potential and one photoconductor layer arranged approximately parallel thereto, which results in a simple construction.

In a further embodiment of the invention, the colors are selected from a number of possible colors of a color palette by means of the print controlling. Each individual color of the color palette is allocated to a developing station of one of the print units, whose toner images can be transferred directly or indirectly onto the front or, respectively, back of the final image carrier. By this means, it is possible that the colors suitable for the respective application are selected according to the specifications of an operator and/or by means of an automatic print job controlling, without its being necessary to manually exchange one or more developer stations. Thus, for example, in addition to the named primary colors, additional decorative colors such as gold or silver can optionally be printed.

In a further embodiment of the invention, the developer stations can be put in place removably, i.e., the developer stations can easily be placed into the print units or removed from the print units. If the print control unit, in place of at least one of the developer stations, optionally activates an additional developer station for the application of colored particles of an additional color, other mixed colors are produced. In this way, the printable color space can be adapted to the print job. If a larger number of predetermined colors, e.g. 10 to 20, are present in developer stations outside the printer, which stations can be placed into the print units with few manual operations and selected with the aid of the print control unit, the printer can be adapted rapidly and easily to a multiplicity of print jobs. For many applications, such as for example business graphics, a number of different colors exceeding the named number is not necessary. If print units are used in which only toner particles of one polarity are used, then the developer stations can be exchanged among one another arbitrarily, since they function in the same manner.

The two last-named embodiments are based on the finding that for many color printing applications, such as for example business graphics, the printing of a few, e.g. two, three or four, color separations leads to a sufficiently good color quality, and that in these print applications the precision of registration of the color separations decisively determines the sought print quality. These print applications are designated business color printing. The sought print quality in business color printing is achieved in that a print image is produced by only a single print unit with, for example, two, three or four developer stations. By replacing the developer stations with developer stations with other toner colors, the printable color range can be adapted rapidly and easily to different print goals. In each case, print images thereby arise without registration errors, with predominantly additive color mixing. Given exchanging of the developer stations, only the stations with the same toner polarity can be exchanged among one another.

In addition, the two last-named embodiments are based on the finding that for full-color printing with high color quality, subtractive color mixtures of the primary colors yellow, magenta, cyan are required, whereby the mixed colors red, blue, green arise from the superposed printing of two respective primary colors. The superposed printing of the toner images of two primary colors requires that these be produced by developer units of different print units and successively transferred onto an image carrier.

In an embodiment of the invention, the fixing process of the toner images does not take place until after the toner images have been superposed and, if warranted, a multicolor print image has been applied on both sides of the carrier material. By means of this measure, it is possible to increase the precision of registration in the superposition of the toner images, since the carrier material is not influenced by the heat that occurs during the fixing of solid colored particles. In addition, additional fixing stations are omitted, so that the printer is of simple construction and consumes considerably less energy.

The invention can be executed with a dry toner, containing only solid colored particles, or with a liquid toner, in which for example the colored particles are contained in a carrier liquid.

In the following, the invention is specified on the basis of embodiments.

Figure 2A:
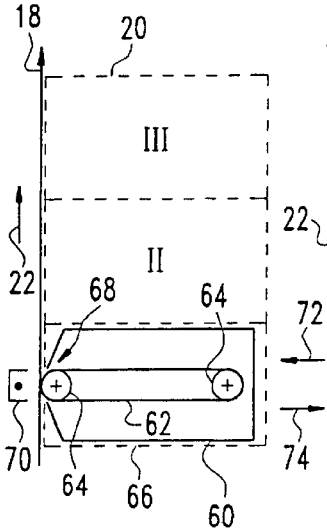
Figure 2B:
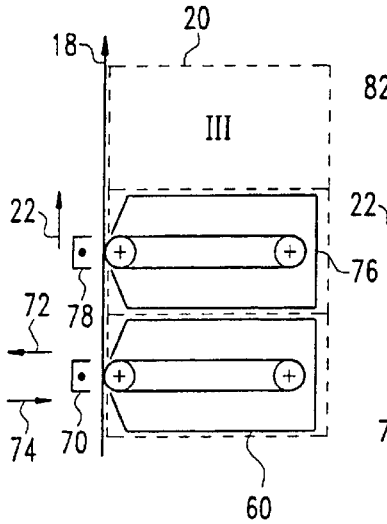
Figure 2C:
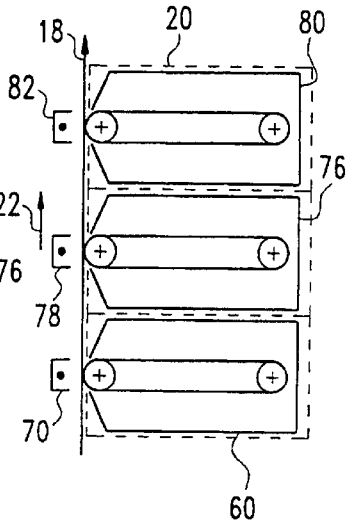
Figure 3A:
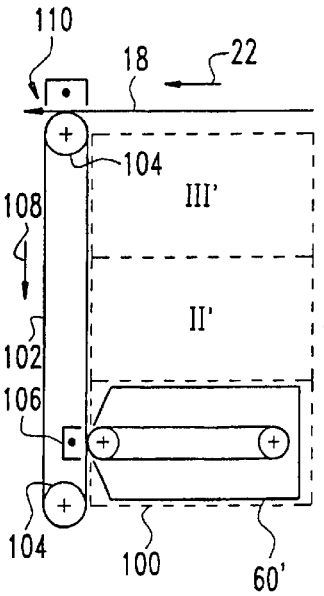
Figure 3B:
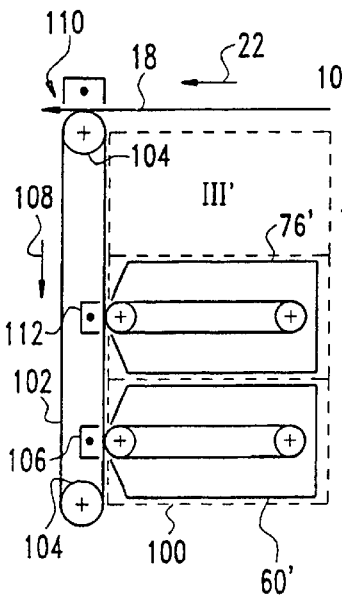
Figure 3C:
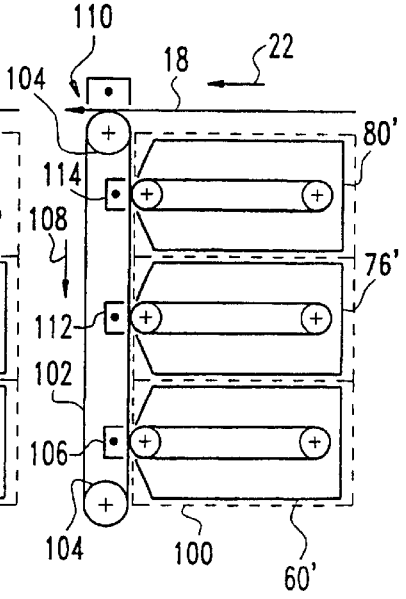
Figure 4:
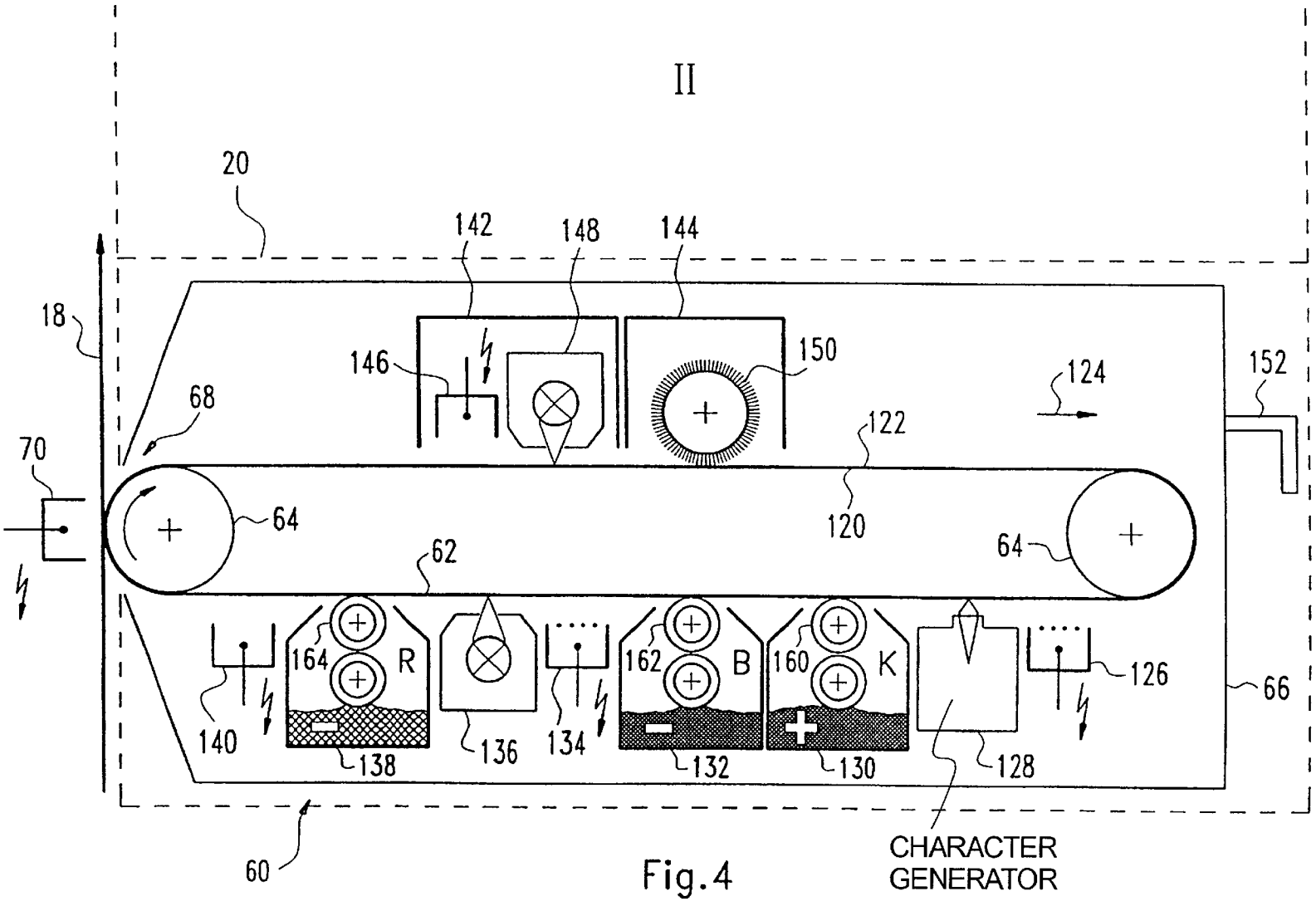
Figure 5:
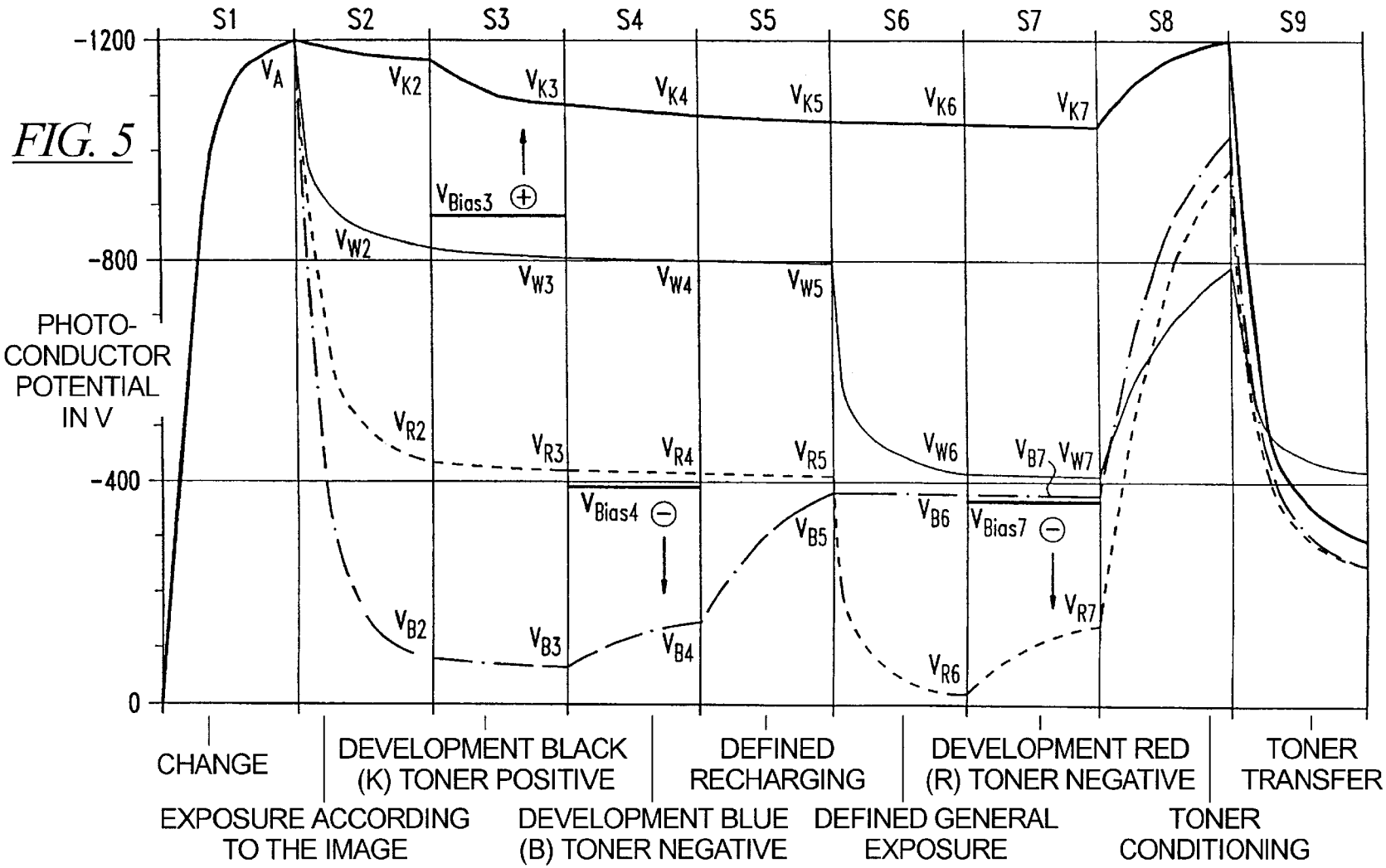
Figure 6:
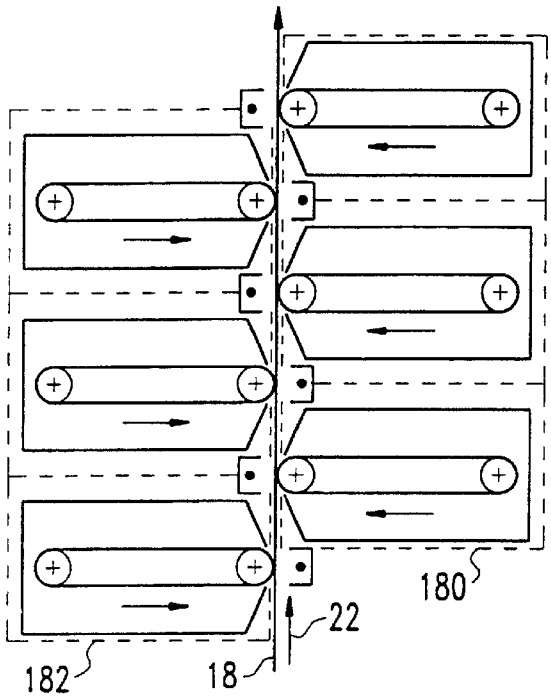
Figure 7:
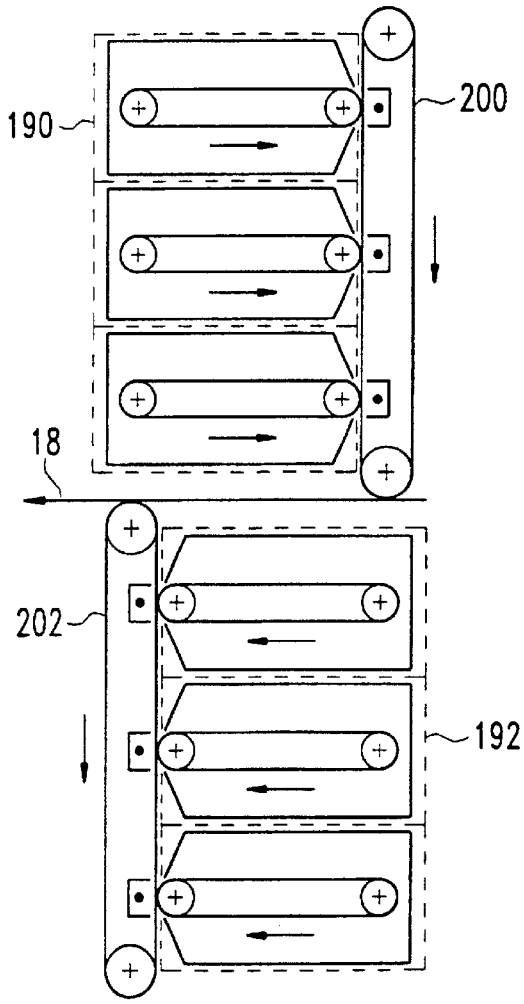
Figure 8A:
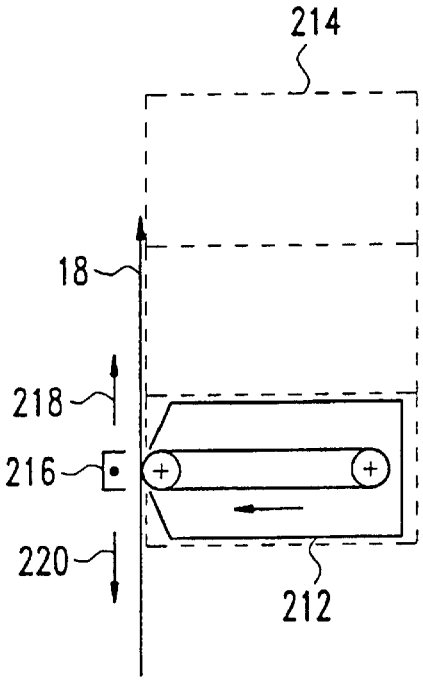
Figure 8B:
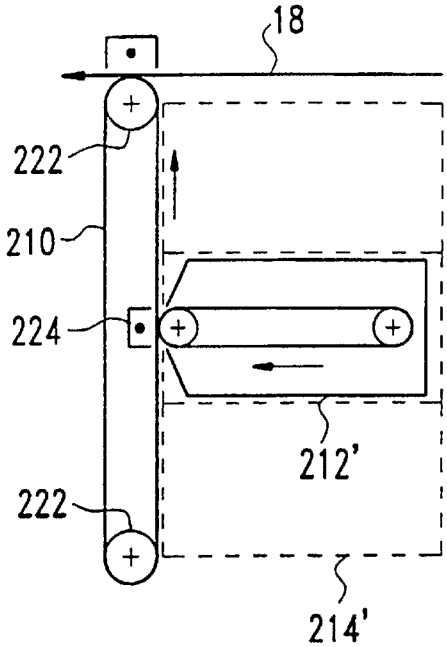

FIG. 1 thereby shows a schematic representation of an electrophotographic printer with essential electronic and mechanical functional units, FIG. 2 shows a print unit receptacle with one print unit, two print units, or, respectively, three print units, FIG. 3 shows a second print unit receptacle with one print unit, two print units, or, respectively, three print units, as well as with an intermediate carrier, FIG. 4 shows the essential functional components of a print unit, FIG. 5 shows the potential curve on the photoconductor given an exposure step and two toner polarities, FIG. 6 shows an embodiment of a printer according to the invention with two print unit receptacles, FIG. 7 shows a further embodiment of a printer according to the invention with two print unit receptacles as well as with an intermediate carrier, and FIG. 8 shows two possibilities of repeat printing in a further embodiment of a printer according to the invention.

FIG. 1 shows a schematic representation of an electrophotographic printer 10 for multicolor printing with essential electrical and mechanical functional units. The printer 10 has a transport means 16, driven by a motor 12 via a shaft 14, for the transport of a carrier material 18 past a print unit receptacle 20, essentially according to a predetermined print speed VD. As an alternative to the endless carrier material 18, given a modified transport individual pages, woven material (e.g. T-shirt), plastic sheets or metal (e.g. for drink cans) can be printed.

In the print unit receptacle 20, according to print requirements with respect to quality of the print image and the number of colors to be printed, print units are contained in print unit plug-in modules I to III, which are arranged one after the other in the direction of transport illustrated by an arrow 22. The design of a print unit is explained in more detail below on the basis of FIG. 4. The print units can easily, e.g. with few manual operations, be placed into the print unit plug-in modules I to III or removed therefrom.

A print unit in the print unit plug-in module I produces a first toner image which is transferred onto the carrier material 18 with the aid of a transfer printing corona means (cf. Part a of FIG. 2). Print units in the print unit plug-in modules II or, respectively, III produce, if necessary, a second or, respectively, third toner image that is transferred onto the carrier material 18, likewise with the aid of transfer printing corona means (cf. Part b and Part c of FIG. 2) allocated to the print units. The second toner image is applied immediately over the first toner image, and the third toner image is applied immediately over the second toner image, so that the toner images are superposed to form the print image.

After the carrier material 18 has been transported past the print unit receptacle 20, it is supplied to a fixing station 24, in which the toner images, which can still be smudged, are melted together with the carrier material 18 in smudge-proof manner with the aid of pressure and temperature. In the transport means 22, seen before the print unit receptacle 20, a first deflection unit 26 is arranged that supplies the carrier material 18 to the print unit receptacle 20. A further deflection unit 28 stacks the printed carrier material 18 on a stack 30. At the beginning of the print process, the carrier material 18 is removed from a stack 32 by the first deflection unit 26. In place of the two stacks 30 and 32, rollers are also used on which the carrier material 18 is rolled.

The print process is controlled by a print control unit 34 that contains at least one microprocessor 36 and a memory 38. The microprocessor 36 executes a print program stored in the memory 38, and thereby controls the print process. In addition, the print control unit 34 prepares image data, likewise stored in the memory 38, and transmits the prepared image data to the print units in the print unit plug-in modules I, II or, respectively, III via control and data buses 40, 42 or, respectively, 44. Via a control line 46, the motor 12 is driven by the print control unit 34 in such a way that, dependent on the print units present in the print unit receptacle 20, the carrier material 18 has an optimal transport speed that essentially agrees with a respective optimal print speed VD.

The print control unit 34 is connected with an input/output apparatus 50 via data lines 48, via which input/output unit, among other things, particular colors from a color palette can be determined for printing.

FIG. 2 shows the print unit receptacle 20 with one print unit, two print units or, respectively, three print units. Part a of FIG. 2 shows the print unit receptacle 20 with a print unit 60 in the print unit plug-in module I. The manner of operation of the print unit 60 is explained in detail below on the basis of FIG. 4. In the print unit 60 there is a photoconductor 62 that is made of a flexible material and that is guided around two deflection rollers 64 inside the print unit 60 in the manner of a conveyor belt. The print unit 60 is surrounded by a chassis 66 made of a stable material. The chassis 66 has an opening 68 past which the photoconductor 62 is guided in the interior of the print unit 60. Outside the print unit 60, the carrier material 18 is guided past the opening 68. A transfer printing corona means 70 is arranged opposite the opening 68, with which means a toner image located on the photoconductor 62 can be transferred onto the carrier material 18.

The print unit 60 can be inserted into the print receptacle 20 in the direction of an arrow 72 until it snaps into a snap receptacle (not shown). The print unit 60 can be removed from the print receptacle 20 by detaching the snap connection and moving it in the direction of an arrow 74, in order for example to refill toner of a particular color, to change colors, or to carry out repairs in the print unit 60.

The variant, shown in Part a of FIG. 2, of the print receptacle 20 with one print unit 60 represents a basic variant by means of which a later expansion or adaptation to further-developed print units is enabled already during the manufacture of the printer 10. A multiplicity of color combination possibilities already result with a single print unit 60. Thus, for example, in addition to black toner particles, toner particles of one or more other colors can also be applied to the photoconductor 62, and subsequently to the carrier material 18, as a first toner image. For black-and-white printing, only toner particles of the color black are applied to the photoconductor 62, in that the print control unit 34 activates only one developer station for black toner particles. The print speed VD is independent of the number of developer stations that are activated.

The developer stations can be placed in or, respectively, removed from the print unit 60 individually, whereby particular colors can be prepared in the print unit 60 before commissioning of the print unit 60, according to printing requirements. During the printing, the print control unit 34 activates the developer stations that are required for the printing. If the print unit 60 contains more developer stations then can be simultaneously activated, the variability is further increased, because the print control unit 34 can activate other developer stations during the printing of various toner images according to the print job. If, for example, a maximum of three developer stations are activated in the print unit 60, and there are five developer stations in the print unit 60, then during printing of a toner image three developer stations, selected by the print control unit 34, of the five existing developer stations can simultaneously be activated.

With such a printer configuration, for example documentation, handbooks or business reports can already be printed with a quality that completely satisfies the demands placed on such printed material.

With the print unit 60 according to the variant of Part a of FIG. 2, given the use of three colors with sufficient distance from one another in the color space, such as for example red, green and blue, a large number of mixed colors can be printed by means of additive color mixing of these colors printed next to one another. A better-registered printing is thereby achieved.

Part b of FIG. 2 shows the print unit receptacle 20 with two print units in the print unit plug-in modules I and II. The print unit 60 is located in the print unit plug-in module I, and in the print unit plug-in module II, which is constructed in the same manner as the print unit plug-in module I, there is a print unit 76 whose construction is essentially similar to that of the print unit 60.

Of course, the print unit 76 can contain other toner colors than the print unit 60. A transfer printing corona means 78 is allocated to the print unit 76, which means transfers a toner image produced by the print unit 76 onto the carrier 18. With the variant according to Part b, it is possible to carry out a subtractive color mixing in addition to an additive color mixing. Given the use of glazing toners—which do not completely absorb incident light, so that the light impinges on a toner layer located underneath—a full-color printing can be carried out. However, in this case the print control unit 34 must convert the color information, given by standard printer languages such as for example Postscript or HP-PCL, in such a way that colors are produced by the print units 60 and 76 that approximate the desired colors.

Part c of FIG. 2 shows the print unit receptacle 20 with the two print units 60 and 76, as well as an additional print unit 80 inserted into the print unit plug-in module III, which is likewise essentially of the same construction as the print unit 60. A transfer printing corona means 82 is likewise allocated to the print unit 80. The variant according to Part c enables full-color printing without special treatment of the color information of the printer language by the print control unit 34. The primary colors, e.g. yellow, magenta or cyan, are distributed to the print units 60, 76 and 80 in such a way that one of the named primary colors is respectively contained in each print unit 60, 76 or, respectively, 80. If one of the print units 60, 76 or, respectively, 80 contains black toner particles, the print quality can be further increased, since in practice pure black cannot be assembled from the named primary colors with sufficient quality. Additional toner particles with particular decorative colors, such as for example silver or gold, can be distributed to developer stations that are still free in the three print units 60, 76 or, respectively, 80.

FIG. 3 shows, in parts a, b or, respectively, c, a second print unit receptacle 100 with print unit plug-in modules I', II' and III', which, in contrast to print unit plug-in modules I, II, and III, contain print units 60'; 60', 76' or, respectively, 60', 76', 80'. By means of the print units 60', 76' and 80', toner images are produced that are not transferred onto the carrier material 18, but rather onto an intermediate carrier material 102, so that an indirect printing takes place. The intermediate carrier material 102 is made of a flexible material that is guided around two deflection rollers 104 in the manner of an endless belt. The print modules 60', 76' and 80' are constructed essentially in the same manner as the print modules 60, 76 and 80.

Part a of FIG. 3 shows the print unit receptacle 100 with a print unit 60' in the print unit plug-in module I, which produces a toner image that is transferred onto the intermediate carrier 102 with a transfer printing corona means 106. The intermediate carrier material 102 is transported in the direction of the arrow 108. If the toner image reaches a transfer printing point 110, the toner image is transferred at the transfer point 110 onto the carrier material 18, which material is likewise transported past the transfer printing point 110. The remarks made on the basis of Part a of FIG. 2 hold with respect to the color combinations to be printed.

Part b of FIG. 3 shows the print unit receptacle 100 with two print units 60' and 76' in the print unit plug-in modules I' and II'. With respect to its carrier characteristics, the intermediate carrier material 102 is selected so that the toner images are applied onto the intermediate carrier material 102 with a high precision, and the positional deviations of the image elements of various toner images from target positions are very small. By means of the use of the intermediate carrier material, the quality of the multicolor printing is increased. A corona means 112 is allocated to the print unit 76', which corona means transfers a toner image, produced by means of the print unit 76', onto the intermediate carrier, and superposes it on the toner image produced in the print unit 60'. The remarks made with reference to Part b of FIG. 2 hold for the colors to be printed.

Part c of FIG. 3 shows the print unit receptacle 100 with three print units 60', 76' and 80' in the print unit plug-in modules I', II' and III'. The print unit 80' is a transfer printing corona means 114 for transferring the toner image produced by the print unit 80' onto the intermediate material 102. With respect to the possible print colors, the remarks made on the basis of Part c of FIG. 2 hold.

FIG. 4 shows the essential functional components of the print unit 60. The photoconductor 62 is made of an electrode layer 120 that conducts a zero potential and a photoconductor layer 122 arranged approximately parallel thereto, which stands in electrical and mechanical contact with the electrode layer 120 over a large surface. The photoconductor 62 is moved in the direction of an arrow 124 by the deflecting rollers 64. A flat strip of the photoconductor 62, lying transverse to the direction of transport, is thereby guided successively past a charge apparatus 126, a character generator 128, a developer station 130 for the application of positively charged toner particles, a developer station 132 for the application of negatively charged toner particles, a charge means 134, a total exposure unit 136, a developer station 138 for the application of negatively charged toner particles, a recharging station 140, the corona means 70, an erase means 142 and a cleaning means 144.

The charge apparatus 126 contains a corona means arranged transverse to the direction of transport 124, which corona means charges a flat strip of the photoconductor 62, respectively positioned transverse to the direction of transport 124 and located in the intermediate vicinity of the charge apparatus 126, in such a way that an initial potential VA of approximately −1200 V arises on the surface of the photoconductor layer in the region of the flat strip (cf. FIG. 5, step S1).

The character generator 128 contains a row of light-emitting diodes arranged transverse to the direction of transport, which respectively illuminate a region of the photoconductor 62 located transverse to the direction of transport 124. The character generator 128 is driven by the print control unit 34 in such a way that image signals at image elements of a line of the print image are respectively simultaneously converted into light signals of the light-emitting diodes. By means of the exposure of the photoconductor 62, the potential increases at the exposed surface elements of the photoconductor 62, because in the exposed regions the photoconductor 62 conducts better, whereby charge bearers can run off from the photoconductor layer 122 to the electrode layer 120 in the region of the exposed surface elements. Surface elements onto which black toner particles are to be applied are not exposed; surface elements onto which no toner particles are to be applied are exposed with a first light energy; surface elements onto which red toner particles are to be applied are exposed with a second light energy higher than the first light energy, and surface elements onto which blue toner particles are later to be applied are exposed with a third light energy higher than the second light energy. The exposure with different light energies is achieved in that the light-emitting diodes emit light with essentially the same light strength over time periods of different length. With increasing exposure time, i.e., with increasing light energy, the potential at the respective surface elements increases (cf. FIG. 5, step S2).

The developer station 130 applies positively charged colored particles of the color black K, using an auxiliary electrode 160 with a potential VBIAS3, onto surface elements that have not been exposed. The exact mechanism of operation is explained below on the basis of FIG. 5 (step S3).

The developer station 132 applies negatively charged toner particles with the color blue B, with the aid of an auxiliary electrode 162 with a potential VBIAS4, onto surface elements that have been exposed with the third light energy. The exact mechanism of operation of the developer station 132 is likewise explained below on the basis of FIG. 5 (step S4).

By means of the application of the negatively charged blue toner particles, the potential at the surface elements that have been exposed with the third light energy is again lowered. In order further to lower the potential on these surface elements, the photoconductor 62 is guided past the charge apparatus 134. With the charge apparatus 134 arranged transverse to the direction of transport, the photoconductor 62, covered partly with toner particles, is charged in the surface elements covered with toner particles to a potential VB5 that is somewhat greater than the potential at the surface elements that were exposed with the second light energy (cf. FIG. 5, step S5).

The relevant strip of the photoconductor 62 is subsequently led past the total exposure unit 136. The total exposure unit 136 contains a laser diode that radiates light energy into a glass fiber array arranged transverse to the direction of transport of the photoconductor 62. The glass fiber array is fashioned such that essentially equal light energy is radiated over its entire length. The light of the total exposure unit 136 cannot radiate through already-applied black or blue toner particles, because it is absorbed by the toner particles. However, if the light of the total exposure unit 136 impinges on surface elements of the photoconductor 62 that are not yet covered with toner particles, the potential at these surface elements is increased (cf. FIG. 5, step S6).

The developer station 138 applies negatively charged toner particles with the color red onto the surface elements of the photoconductor 62 exposed with the second light energy. An auxiliary electrode 164 with the potential VBIAS7 is thereby used. The exact manner of operation of the application of the red toner particles is likewise explained below on the basis of FIG. 5 (step S7).

In the recharging station 140, the positively charged black toner particles are recharged, so that all toner particles applied on the photoconductor 62 are negatively charged (cf. FIG. 5, step S8). By means of this measure, it is achieved that the transfer of the toner image from the photoconductor 62 onto the carrier material 18 is reliably executed with the aid of the corona means 70.

After the transfer of the toner image, the photoconductor 62, now essentially free of colored particles, is led past the erase means 142, in a step not shown. The erase means 142 contains a corona means 146 and an exposure unit 148 by means of which residual charges present on the photoconductor are removed.

Toner particles still remaining on the photoconductor 62 after the transfer of the toner image are removed from the photoconductor 62 in the cleaning means 144 with the aid of a brush 150. After being transported past the cleaning means 144, the relevant strip of the photoconductor 62 is again in a clean initial state and has approximately the same potential at all points.

On its side facing away from the carrier material 18, the chassis 66 has a handle 152 with which the print unit 60 can conveniently be removed from the print unit plug-in module I or placed into the print unit plug-in module I.

FIG. 5 shows the potential on the surface of the relevant strip of the photoconductor 62, given an exposure step and two toner polarities. Time is plotted on the abscissa, and is divided into nine successive time steps S1 to S9. On the ordinate, the potential on the surface of the photoconductor 62 is shown with reference to the potential on the electrode layer 120.

In step S1, the potential on the surface of the photoconductor 62 is lowered by means of the action of the field of the charge means 126 to the initial potential VA, which, as already mentioned, has the value −1200 V.

Step S2 shows the potential curve on the surface of the photoconductor 62 given exposure according to an image with the aid of the character generator 128. Surface elements that are later to be covered with black toner particles are not exposed. In the course of step S2, at these surface elements the potential VA increases only slightly, due to a self-discharging —which cannot be suppressed—of the photoconductor 62, to a value VK2. The potential at the surface elements exposed with the first light energy increases to a value VW2 of approximately −800 V. The potential at the surface elements that were exposed with the second light energy increases to a potential value VR2 of approximately −400 V in the course of step S2. The potential at the surface elements that were exposed with the third light energy increases approximately to a potential value VB2 of approximately −100 V in step S2. The light energies during exposure are dimensioned such that, taking into account the non-linear photoelectrical characteristics of the photoconductor 62, the potentials VK2, VW2, VR2 and VB2 respectively differ by approximately 400 V.

In step S3, the black toner particles are applied by the developer station 130. The auxiliary electrode 160 in the immediate vicinity of the photoconductor 62 has the auxiliary potential VBIAS3 of approximately −900 V. The positively charged black toner particles are located at the auxiliary electrode 160. Since the potential VBIAS3 is lower than the potentials VW2, VR2 and VB2, these potentials are positive with respect to the potential VBIAS3. However, the positively charged black toner particles can be applied only onto a surface that has a lower potential than the potential VBIAS3. This holds only for surface elements that were not exposed in step S2, and that have the potential VK2 at the beginning of step S3. Accordingly, the black toner particles are applied onto these surface elements. During the application of the positively charged toner particles, the potential at the surface elements respectively covered with toner particles increases to a potential value VK3. By means of the mentioned unavoidable self-discharging of the photoconductor 62, the potentials VW2, VR2 or, respectively, VB2 increase slightly to the potential values VW3, VR3 or, respectively, VB3.

In step S4, the blue toner particles are applied by the developer station 132. The auxiliary electrode 162 in the immediate vicinity of the photoconductor 62 has the auxiliary potential VBIAS4 of approximately −390 V. Negatively charged blue toner particles are located at the auxiliary electrode 162. Since the potential VBIAS4 is higher than the potentials VK3, VW3 and VR3, these potentials are negative with respect to the potential VBIAS4. However, the negatively charged blue toner particles can be applied only to a surface that has a potential higher than the potential VBIAS4. This holds only for surface elements that were exposed with the third light energy in step S2 and have the potential VB3 at the beginning of step S4. Accordingly, the blue toner particles are applied to these surface elements. By means of the application of the negatively charged blue toner particles, the potential at the surface elements respectively covered with blue toner particles is reduced to a potential value VB4. Due to the self-discharging of the photoconductor 62, the potentials VK3, VW3 or, respectively, VR3 increase slightly to the potential values VK4, VW4 or, respectively, VR4.

In step S5, the potential VB4 on the surface of the surface elements covered with blue toner particles is reduced to approximately −390 V with the aid of the charge apparatus 134. Due to the self-discharging of the photoconductor 62, the potentials VK4, VW4 or, respectively, VR4 increase in step S5 to the potentials VK5, VW5 or, respectively, VR5.

In step S6, by means of the light emitted by the total exposure unit 136 the potentials VW5 or, respectively, VR5 at the surface elements not covered with toner particles are respectively increased by approximately 400 V to the potentials VW6 or, respectively, VR6. The potential at surface elements that were exposed in step S2 with the second light energy is increased in step S6, by means of the additional exposure, to the highest potential of all surface elements in step S6. The potentials VK5 or, respectively, VB5 increase slightly due to the self-discharging of the photoconductor 62, to the potentials VK6 or, respectively, VB6. There is a difference of approximately 400 V between the potentials VR6 and VB6, so that in the following step S7, similar to step S4, toner particles can be applied to the surface elements that were exposed with the second light energy in step S2.

In step S7, the red toner particles are applied by the developer station 138. The auxiliary electrode 164 in the immediate vicinity of the photoconductor 62 has the auxiliary potential VBIAS7 of approximately −370 V. The negatively charged red toner particles are located on the auxiliary electrode 164. Analogous to the electrical conditions described in step S4, the negative toner particles are applied onto the surface elements that were exposed with the second light energy in step S2. The potentials VK6, VW6 or, respectively, VB6 increase to the potential values VK7, VW7 or, respectively, VB7, due to the self-discharging of the photoconductor 62.

In step S8, the relevant strip of the photoconductor 62 is guided past the recharging station 140. The recharging station 140 contains a corona means that has a saturation potential value of approximately −1200 V. During the transporting past, the potentials at all surface elements are reduced considerably, whereby the polarity of the black toner particles changes.

In step S9, the toner particles of surface elements covered with toner particles are transferred onto the carrier material 18, essentially maintaining their position relative to one another. The potential on the surface elements of the photoconductor 62 is thereby increased to approximately −400 V. The still-present residual charge on the photoconductor 62 is removed by the erase means 142, so that after passing the erase means 142 the photoconductor 62 has a potential value of approximately 0 V on its surface.

The method according to the invention, explained on the basis of FIG. 5, can be modified so that all polarities are exchanged or that only toner particles of one polarity are used. In the latter case, step S3 is omitted. According to the number of colors required for printing the print image, in step S2 different light energies are radiated onto the respective surface elements. By means of n-fold repetition of steps S5, S6 and S7 before step S8, toner particles of n different additional colors can be applied onto allocated surface elements. The number n is thereby a whole number, e.g. one, two, three, etc.

FIG. 6 shows an embodiment of a printer according to the invention with two print unit receptacles 180 and 182, respectively constructed in the manner of the print unit receptacle 20. By means of the arrangement shown in FIG. 6, a printing on both sides of the carrier material 18 can take place. A printer with two print unit receptacles 180, 182 according to FIG. 6 can be adapted to a broad spectrum of client desires and levels of print quality. Thus, for example, given three supplied print units, all three print units can be inserted into the print unit receptacle 180 or into the print unit receptacle 182. Alternatively, the three print units can also be distributed to the two print receptacles 180 and 182 for two-sided printing. However, two-sided printing is also possible without the print unit receptacle 182 if the carrier material 18 is turned after a first printing and is again led past the print unit receptacle 180.

FIG. 7 shows a further embodiment of a printer according to the invention with two print unit receptacles 190 and 192. The print unit receptacles 190 and 192 are respectively fashioned similar to the print unit receptacle 20. The difference from FIG. 6 is that in FIG. 7 toner images are transferred from the print units onto the carrier material 18 not directly, but rather via intermediate carrier materials 200 or, respectively, 202. With the variant shown in FIG. 7, a two-sided printing is accordingly possible without the carrier material 18 coming into contact with the photoconductors of the print units. Wear of the photoconductor by the carrier material 18 is thus avoided.

FIG. 8 shows two possibilities of what is called "repeat printing." Instead of two or three print units operating in chronologically parallel fashion, only one print unit is used in two or, respectively, three printing steps in order to produce toner images that can respectively be printed in chronologically successive fashion onto the carrier material 18 or, respectively, onto an intermediate carrier material 210.

Part a of FIG. 8 shows repeat printing in which the toner images are superposed directly onto the carrier material 18. With the aid of a print unit 212 located in a print unit receptacle 214, in a first printing step a first toner image is applied onto the photoconductor present in the print unit 212. With the aid of a corona means 216, the first toner image is transferred onto the carrier material 18, which is moved in the direction of an arrow 218. The print unit 212 is constructed essentially in the manner of the print unit 60.

In the printing of the first toner image, one or more developer stations are activated by the print control unit 34, which stations apply colored particles of the desired colors onto the photoconductor.

After the transfer of the first toner image onto the carrier material 18, this material is transported back by the transport means 16 in the direction of an arrow 220, contrary to the direction of transport 218 during the transfer of the toner images. In further printing steps, additional toner images are superposed on the first toner image, whereby the print control unit 34 respectively activates other developer stations in the print unit 212.

Part b of FIG. 8 shows repeat printing on the intermediate carrier material 210 with a print unit 212'. A back-transporting of the carrier material 18 can be omitted, and is replaced by halting of the carrier material 18. The intermediate carrier material is guided by two deflection rollers 222, and circulates in the manner of a conveyor belt. In each circulation of the intermediate carrier material 210, a toner image can be applied onto the location provided for the print image. If all toner images have been applied, the transfer of the superposed toner images onto the carrier material 18 takes place with the aid of a corona means 224. For this purpose, the carrier material 18 is moved synchronously to the intermediate carrier material for the duration of one circulation of the intermediate carrier material.

The print unit 212 is located in a print unit receptacle 214, and the print unit 212' is located in a print unit receptacle 214'. If additional print units are inserted into the print unit receptacle 214 or, respectively, 214', the print control unit 34 changes over from repeat printing to parallel printing.

Two-sided repeat printing is also provided by means of the use of an additional print unit receptacle.

What is claimed is:

1. A method for two-sided printing of a continuous web final image carrier, comprising the steps of:

halting of a final image carrier, production of toner images on a photoconductor of a single print unit allocated to a front of the final image carrier, production of toner images on a photoconductor of a single print unit allocated to a back of the final image carrier, transfer, in chronological succession, of the toner images of said single front-side print unit onto a location provided for a print image on a first intermediate carrier allocated to the front, the first intermediate carrier circulates in the manner of a conveyor belt to superimpose the toner images on each circulation of the first intermediate carrier for production of a superposed front-side toner image, transfer, in chronological succession, of the toner images of said single back-side print unit onto a location provided for a print image on a second intermediate carrier allocated to the back, the second intermediate carrier circulates in the manner of a conveyor belt to superimpose the toner images on each circulation of the second intermediate carrier for production of a superposed back-side toner image, simultaneous transfer of the front-side toner image and the back-side toner image onto the final image carrier, the final image carrier being moved synchronously with the first and second intermediate carriers.

2. A method according to claim 1, further comprising the step of:

providing a common fixing of the front-side and back-side toner image in a fixing station arranged downstream of the simultaneous transfer in the direction of transport of the final image carrier.

* * * * *